US007115078B1

(12) United States Patent
Kalember et al.

(10) Patent No.: US 7,115,078 B1
(45) Date of Patent: Oct. 3, 2006

(54) ORBITAL RESISTANCE-ADJUSTABLE SPHERE EXERCISING APPARATUS

(76) Inventors: Robert S. Kalember, 19431 Business Center Dr. #41, Northridge, CA (US) 91324; Michael W. Knight, 19431 Business Center Dr. #41, Northridge, CA (US) 91324

( * ) Notice: Subject to any disclaimer, the term of this patent is extended or adjusted under 35 U.S.C. 154(b) by 384 days.

(21) Appl. No.: 10/784,496

(22) Filed: Feb. 20, 2004

Related U.S. Application Data

(60) Provisional application No. 60/449,259, filed on Feb. 21, 2003.

(51) Int. Cl.
*A63B 21/015* (2006.01)

(52) U.S. Cl. ..... 482/117; 482/133; 482/139

(58) Field of Classification Search ..... 482/92, 482/114, 115, 117, 133, 139, 142
See application file for complete search history.

(56) References Cited

U.S. PATENT DOCUMENTS

| | | | | | |
|---|---|---|---|---|---|
| 212,946 | A * | 3/1879 | Johnson | 482/117 |
| 1,535,391 | A * | 4/1925 | Anderson | 482/117 |
| 2,909,371 | A * | 10/1959 | Alcover | 482/148 |
| 2,921,791 | A * | 1/1960 | Berne | 482/118 |
| 3,428,311 | A * | 2/1969 | Mitchell | 482/45 |
| 3,587,319 | A * | 6/1971 | Andrews | 482/112 |
| 3,782,721 | A * | 1/1974 | Passera | 482/117 |
| 4,036,490 | A * | 7/1977 | Rice | 482/49 |
| 4,249,727 | A * | 2/1981 | Dehan | 482/117 |
| 4,603,856 | A * | 8/1986 | Fiore | 482/114 |
| 5,013,034 | A * | 5/1991 | March et al. | 482/115 |
| 5,244,444 | A * | 9/1993 | Wostry | 482/97 |
| 5,273,509 | A * | 12/1993 | Vittone | 482/139 |
| 5,393,280 | A * | 2/1995 | Haviv | 482/56 |
| 2003/0013586 | A1 * | 1/2003 | Rothschild | 482/117 |

FOREIGN PATENT DOCUMENTS

| | | | |
|---|---|---|---|
| FR | 2564735 | A1 * | 11/1985 |
| GB | 2147212 | A * | 5/1985 |

* cited by examiner

*Primary Examiner*—Jerome Donnelly
*Assistant Examiner*—Victor K. Hwang
(74) *Attorney, Agent, or Firm*—Albert O. Cota

(57) ABSTRACT

An orbital resistance-adjustable sphere exercising apparatus (10) that is designed to allow several exercise routines to be performed through several planes and range-of-motion at selectable friction levels. The apparatus (10) consists of four major elements: a sphere cradle (12), a sphere (116), a set of three sphere friction pads (42, 54, 94) and a telescoping pole assembly (126). The sphere cradle (12) includes a base (14) that has attached three sphere support frames (32, 52, 92) that are evenly spaced and that each have attached the friction pads (42, 54, 94) that interface with and support the sphere (116). The sphere cradle (12) also includes a sphere friction adjusting rod (104) that when rotated clockwise the three sphere support frames (32, 52, 92) simultaneously extend inward allowing the friction applied by the three friction pads (42, 54, 94) to the sphere (116) to increase. Likewise, when the rod (104) is rotated counter-clockwise the applied friction is reduced.

23 Claims, 7 Drawing Sheets

ORBITAL RESISTANCE-ADJUSTABLE SPHERE EXERCISING APPARATUS

This application claims priority of Provisional Patent Application 60/449,259 dated Feb. 21, 2003.

TECHNICAL FIELD

The invention pertains to the general field of exercising apparatuses and more particularly to an exercising apparatus that uses a resistance-adjustable sphere that is attached to a telescopic pole. When the upper end of the pole is grasped exercising routines encompassing a full range-of-motion can be performed.

BACKGROUND ART

Since the earliest days of humankind, there has been a need and desire for physical exercise. It is readily apparent when two individuals, one of whom exercises and the other does not, attempt to do a physically strenuous activity. The person who exercises and maintains him/her self in good physical condition not only is usually able to perform better, but also for a longer duration with less stress.

The medical community has embraced exercise and many doctors and other health care professionals have begun "prescribing" a consistent routine of exercises in addition to medicine. This increased awareness and necessity for exercise has resulted in a rapidly growing number of health clubs, gyms and personal fitness machines and equipment. Some health clubs and fitness machines have become very popular and widely used, but many health clubs and machines have lost much of their popularity because of their complexity, size and cost.

As a result of the diminished exposure of exercise, many companies that had previously invested large amounts of time and money in developing new types of exercising machines no longer do so. This is unfortunate because many individuals in the medical community have continued their research into the human body and how it reacts to stress, exercise, etc., and with these new findings there has become available a better understanding of how best to exercise.

The ability to use current knowledge and technology for designing new and improved exercise machines is one of the most effective ways to guarantee future body conditioning and maintenance. By utilizing advanced technology, the instant exercising apparatus solves many of the problems inherent in previously available exercising apparatuses.

A search of the prior art did not disclose any literature or patents that read directly on the claims of the instant invention. However, the following U.S. patents are considered related:

| PATENT NO. | INVENTOR | ISSUED |
|---|---|---|
| 5,692,997 | Stearns | Dec. 2, 1997 |
| 5,665,041 | Hsieh | Sep. 9, 1997 |
| 5,273,509 | Vittone | Dec. 28, 1993 |
| 5,069,447 | Snyderman, et al | Dec. 3, 1991 |
| 2,543,729 | Magida | Feb. 27, 1951 |

The U.S. Pat. No. 5,692,997 patent discloses an exercise machine having a platform on which a user is supported in a reclining position with the weight of the user being utilized as a resistance. The resistance may be selectively varied to the various exercises, which may be performed on the exercise apparatus. A lever is pivotally connected to the platform with the lever being actuated by the user for raising one end of the platform with respect to a pivot point. The pivotal mounting of the lever on the platform varies the resistance to such raising.

The U.S. Pat. No. 5,665,041 patent discloses an abdominal exercise apparatus wherein upper and lower body supports are provided and interconnected to coordinate upper and lower abdominal workouts. The apparatus provides resistance for the abdominal exercises.

Further, the interconnection between the upper and lower body supports may be selectively disconnected so that individual upper and lower abdominal exercises can be performed.

The U.S. Pat. No. 5,273,509 patent discloses a handle for an exercise machine having a force resistor such as a cable system, wherein a weight stack supplies resistance to movement of the handle along a path through the interconnecting cable system. The handle includes a grip supported on an elongate arm and a base includes structure for connecting the handle to the force resistor.

The U.S. Pat. No. 5,069,447 patent discloses an adjustable weight-lifting bench that is adapted to be converted from a flat to a sitting position with little or no displacement of the user's head and shoulders in relation to the stationary upright barbell supports. The bench seat frame is pivotally connected to the back frame, a second end of the seat frame is pivotally connected to one end of a support arm, and the second end of the support arm is pivotally connected to a base frame.

The U.S. Pat. No. 2,543,729 patent discloses an exercising device for use in gymnasiums, or homes. The device includes a structure consisting of a pair of arms pivoted together at one end by means of friction disks. The disks can be adjusted to vary the resisting friction and in which the device is free to be swing as desired.

DISCLOSURE OF THE INVENTION

The orbital resistance-adjustable sphere exercising apparatus provides an exerciser with multi-functional resistance training by performing exercising routines that can be conducted through several planes and range-of-motion. These exercising routines are each conducted with an equal friction that can be selectively adjusted and that is constant throughout a 360-degree range-of-motion. The exercising routines simultaneously force stability and movements that mimic the body's own pattern as it moves naturally.

In its basic form the apparatus consists of four basic elements:

1. A sphere cradle having a base that includes a means for supporting three evenly spaced sphere friction pads.

2. A sphere that is supported by the three sphere friction pads and that includes an upper inner pole cavity.

3. Means for adjusting the friction that is equally applied to the surface of the sphere by the three sphere friction pads.

4. A telescoping pole assembly having a lower end that is inserted into the upper inner pole cavity and an upper end that is attached to an articulated handle.

The sphere cradle in a preferred design has an equilateral triangular shape. Each side of the triangle has an upward extending sphere support frame that has attached a sphere friction pad having a concave surface that makes contact with the circular surface of the sphere. The sphere cradle also includes the means for selectively adjusting the amount of friction the friction pads apply to the surface of the sphere.

The sphere can consist of a solid sphere or a hollow sphere that is preferably constructed of aluminum that is anodized. In each case, the sphere includes a set of cavities that allow an inner pole of the telescoping pole assembly to be secured to the sphere.

The telescoping pole assembly includes the inner pole that is inserted into an outer pole. The assembly includes a means for securing the outer pole at a selectable height with respect to the inner pole. The articulated handle that is attached to the upper end of the outer pole preferably consists of a T-slot articulated handle that allows rotation in two planes to permit freedom of movement in any direction and angle.

The combination of the articulated handle, the telescoping pole assembly and the friction produced by the sphere allows the full range-of-motion exercising routines to be performed. The apparatus can be used by utilizing a single apparatus or two apparatuses can be placed side-by-side. Also, the apparatus can be attached, via the sphere cradle, to a substantially flat surface such as a floor, or the apparatus can be attached to a portable platform. The portable platform can be designed to have attached an adjustable seat and backrest that can be collapsed for stowage or when traveling.

In view of the above disclosure it is the primary object of the invention to produce an orbital resistance-adjustable sphere exercising apparatus that allows a person to perform a series of full range-of-motion exercising routines each of which can be performed at selectable resistance levels.

In addition to the primary object of the invention it is also an object to produce an exercising apparatus that:

- allows for rapid but controlled increase in the heart rat by providing isotonic resistance in a variety of multi-plane exercising movements,
- can be used with a single pole or with two poles,
- if the exerciser release the handles, the poles remain in their last used position. In other words none of the elements comprising the apparatus will drop, fly or snap off,
- can be inserted to a vertical wall as well as to a horizontal surface, can be used in outer space,
- can be used while standing, sitting or in a prone position, and is cost effective from both a manufacturer's and consumer's point-of-view.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
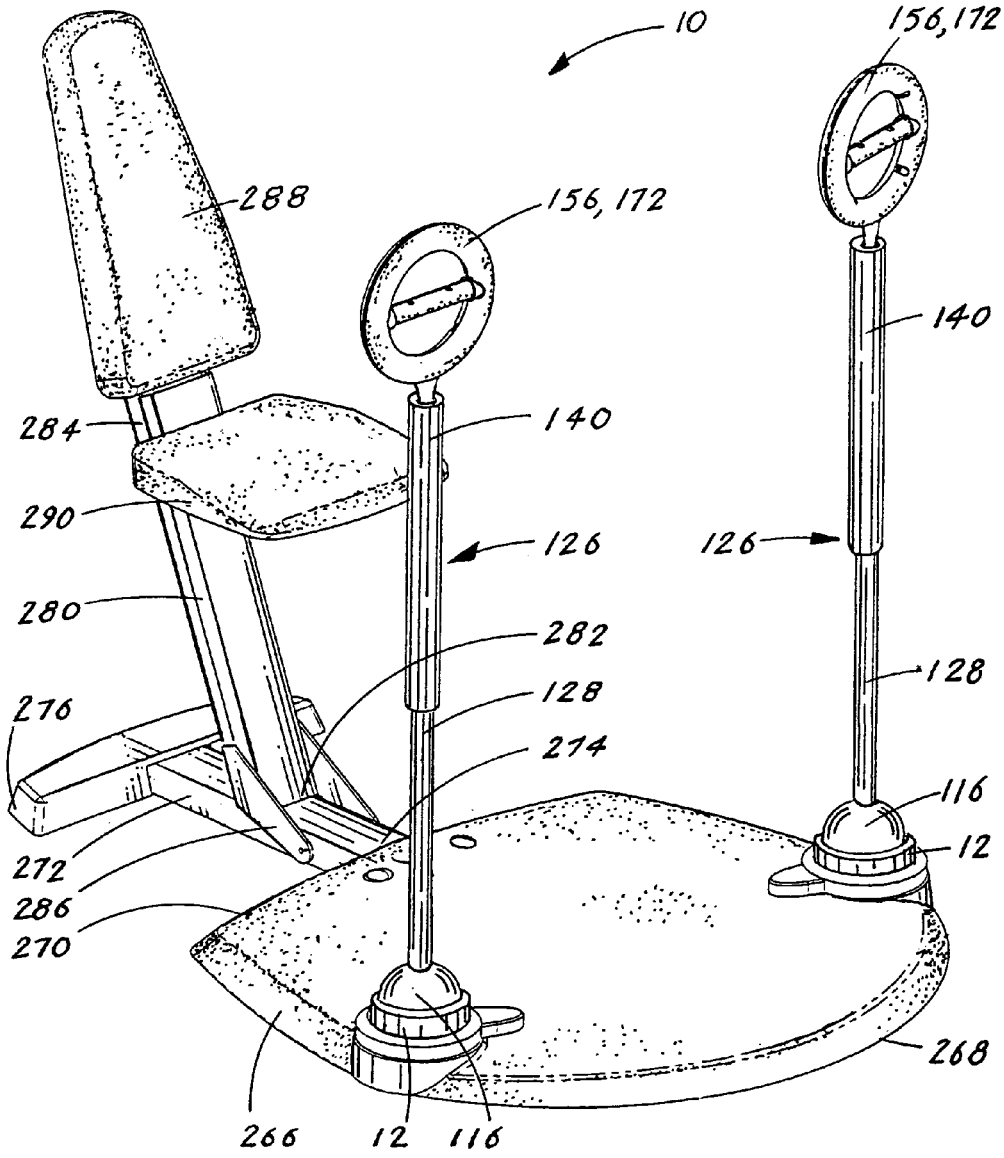
FIG. 1 is a perspective view of an orbital resistance-adjustable sphere exercising apparatus having a pair of telescoping pole assemblies attached to a portable platform that includes a seat rail having attached a collapsible seat.

The best mode for carrying out the orbital resistance-adjustable sphere exercising apparatus 10 is presented in terms of a preferred embodiment that allows rapid and controlled increase in heart rate by providing isotonic resistance in multi-plane exercising routines. The preferred embodiment, as shown in FIGS. 1–8, is comprised of three basic elements, a sphere cradle 12, a sphere 116 and a telescoping pole assembly 126. The three basic elements can also be adapted to be used in combination with a portable platform 266 that has attached a seat rail 272 that has attached a collapsible back support 288 and seat 290.

The seat rail 272 has a front section 274 and a rear T-section 276. The front section 274 is centrally attached to the rear edge 270 of the portable platform 266. A vertical member 280 is collapsibly attached to the seat rail 272 and has a lower section 282 and an upper section 284, with the lower section 282 having means 286 for being moved forward an backward along the seat rail. The upper section 284 has attached the back support 288 and below the back support 288 is the collapsible seat 290. When the seat 290 is collapsed against the vertical member 280, the vertical member 280 is collapsed forward along the portable platform 266, and the telescoping pole assemblies 126 are rotated into a flat position in a stowed or traveling position.

Figure 2:
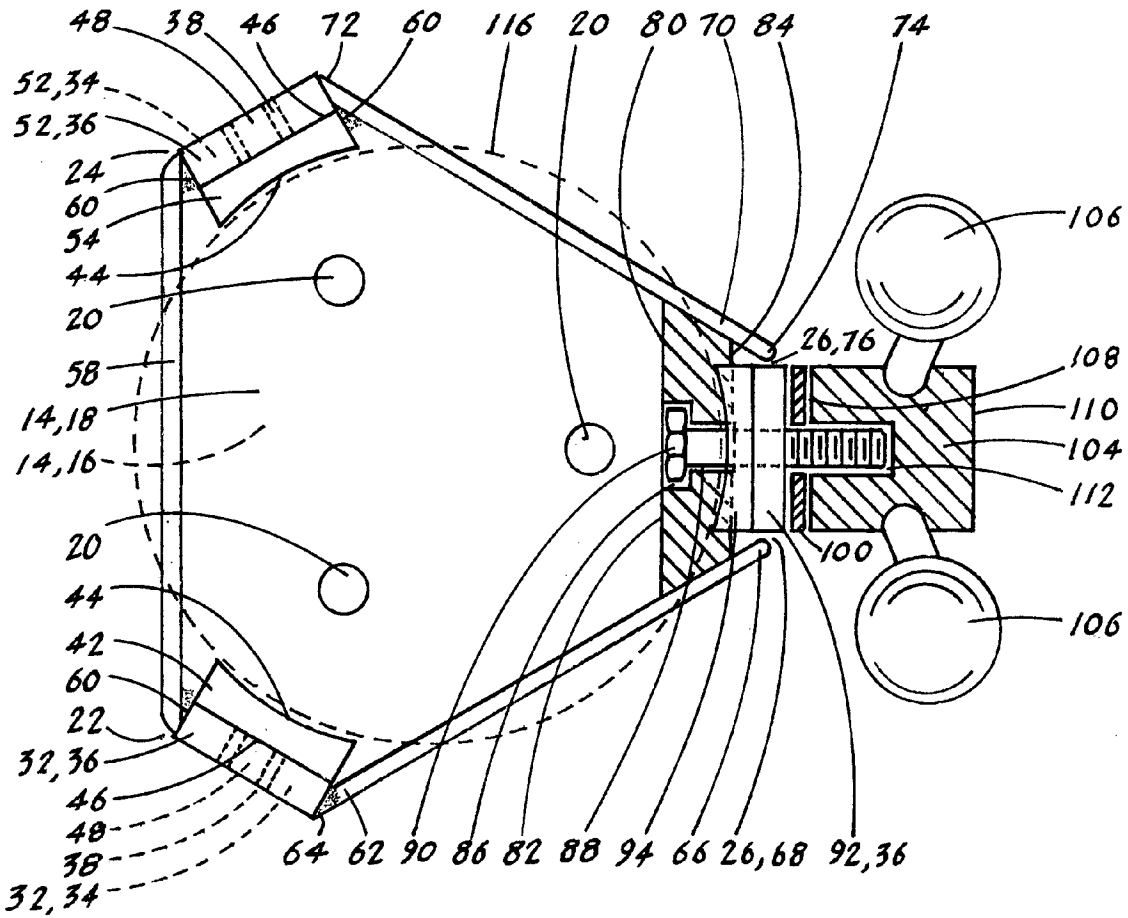
FIG. 2 is a top plan view of a sphere cradle showing the relative locations of three evenly-spaced friction pads and a sphere pressure adjusting rod.
Figure 3:
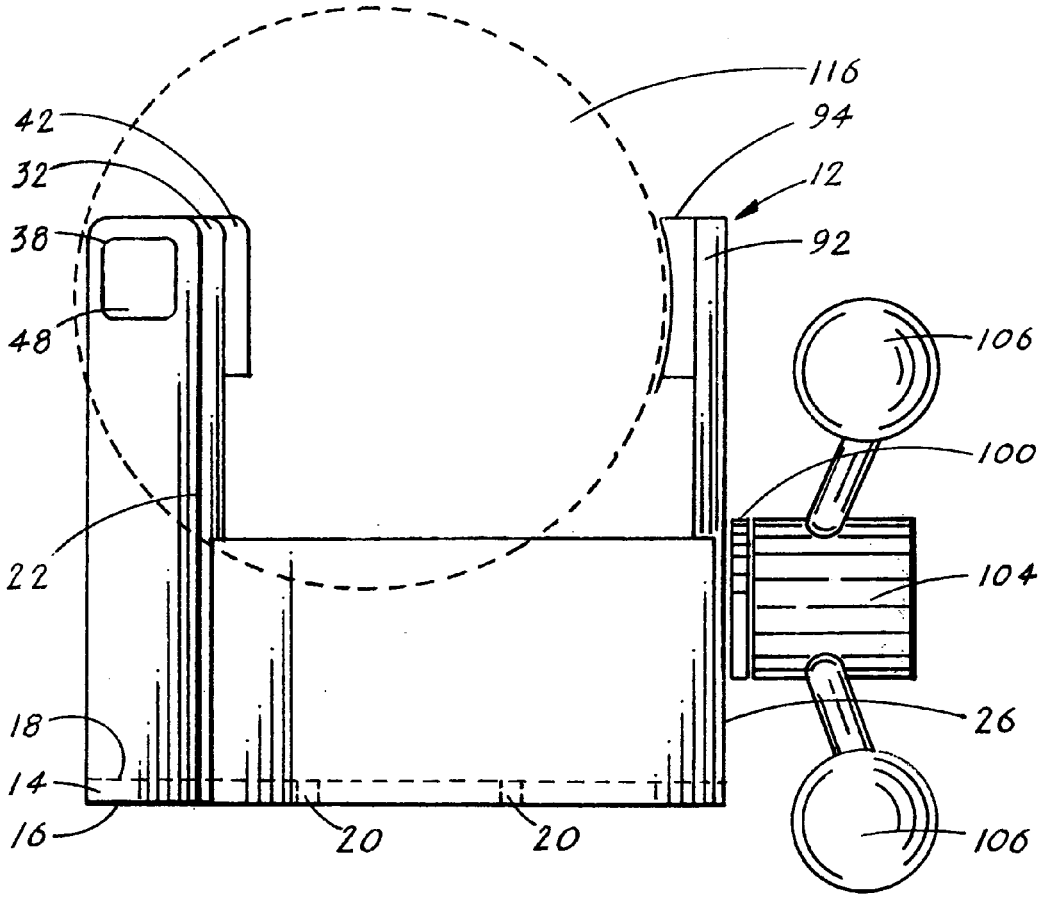
FIG. 3 is a side elevational view of the sphere cradle assembly as shown in FIG. 2.

The sphere cradle 12, as shown in FIGS. 1, 2 and 3, is comprised of a base 14 having an equilateral triangular shape. As shown best in FIGS. 2 and 3, the base 14 includes a lower surface 16, an upper surface 18, a plurality of mounting bores 20 for retaining a plurality of mounting bolts, a front truncated apex 22, a second truncated apex 24 and a third truncated apex 26. The sphere cradle 12, as also shown in FIGS. 2 and 3, is also comprised of a first sphere support frame 32, a first sphere friction pad 42, a second sphere support frame 52, a second sphere friction pad 54, a third sphere support frame 92, a third sphere friction pad 94, a first side panel 58, a second side panel 62 and a third side panel 70.

The first sphere support frame 32 has a lower edge 34, an upper edge 36 and a first sphere friction pad opening 38 located adjacent the upper edge 36. The lower edge 34 is in alignment with the lower surface 16 of the base 14 and is located against the first truncated apex 22. The first sphere friction pad 44 has an inner concave surface 40 that follows the curvature of the sphere 116, an outer surface 46 having a protrusion 48 that is dimensioned to be inserted and frictionally held within the first sphere friction pad opening 38, as shown in FIGS. 2 and 3.

The second sphere support frame 52 also has a lower edge 34, an upper edge 36 and a second sphere friction pad opening 38 located adjacent the upper edge 36. The lower edge 34 is in alignment with the lower surface 16 of the base 14 and is located against the second truncated apex 24. The second sphere friction pad 54 has an inner concave surface 44 and an outer surface 46 having a protrusion 48 that is dimensioned to be inserted and frictionally held within the second sphere friction pad opening 38 as also shown in FIGS. 2 and 3.

The first side panel 58 is fixedly attached, by an attachment means 60 between the first sphere support frame 32 and the second sphere support frame. The second side panel 62 has a first edge 64 that is fixedly attached by an attachment means, to the first sphere support frame 32 and a second edge 66 that terminates at a first edge 68 of the third truncated apex 26. Likewise, the third side panel has a first edge 72 that is fixedly attached by an attachment means 60 to the second sphere support frame 52 and a second edge 74 that terminates at a second edge of the third truncated apex 26.

As shown in FIG. 2, a cross-member 80 is attached inward and across the second edges 66 and 74 of the second side panel 62 and the third side panel 70 respectively. The cross-member 80 has an inner surface 82 and an outer surface 84, with the inner surface 82 having a bolt-head retaining cavity 86 that interfaces with a bolt bore 88 extending therethrough. Into the bolt bore 88 is inserted a pressure adjusting threaded bolt 90 having a bolt head that is captively held within the bolt-head retaining cavity 86 and a threaded section that extends outward from the plane of the third truncated apex 26, as shown in FIG. 2.

The third sphere support frame 92 also has a lower edge 34 that is in alignment with the lower surface 16 of the base 14 and is located between the second edge 66 of the second side panel 62 and the second edge 74 of the third side panel 70. A third sphere friction pad 94 having an inner concave surface 44 and an outer surface 46 having a protrusion 48 that is dimensioned to be inserted and frictionally held within the third sphere friction pad opening 38.

The base 14, the support frames 32,52,92, the first, second and the third side panels 58,62,70 are preferably attached by a welding process. The entire sphere cradle 12 is then preferably chrome plated. Also, the sphere friction pads are preferably made of ultrahigh molecular weight polyethylene (UHMW-PE).

The amount of friction applied by the sphere friction pads is controlled by a combination consisting of the cross-member 80, a washer 100 that preferably consists of a steel needle-roller thrust bearing, the pressure adjusting threaded bolt 90 and a sphere pressure adjusting rod 104.

The sphere pressure-adjusting rod 104 has an inner surface 108 and an outer surface 110. The inner surface 108 has a threaded cavity 112 that is threaded into the threaded section of the pressure adjusting threaded bolt 90, with the inner surface 108 interfacing with the washer 100. When the sphere pressure adjusting rod 104 is rotated clockwise, the third sphere support frame 92 moves inward, thus allowing the three sphere friction pads 42,54,94 to simultaneously extend inward and each apply an equal inward friction. Likewise, when the rod 104 is rotated counter-clockwise the equal inward friction is reduced. To facilitate the rotation of the rod 90, a plurality of outward extending knobs 106 can be attached to the rod 104, as shown in FIGS. 1 and 2. The second major element of the apparatus 10 is the sphere 116, which preferably is constructed of aluminum that can be clear anodized or anodized in a variety of colors. The sphere 116 can be produced in two designs: a solid design or a hollow design.

Figure 4:
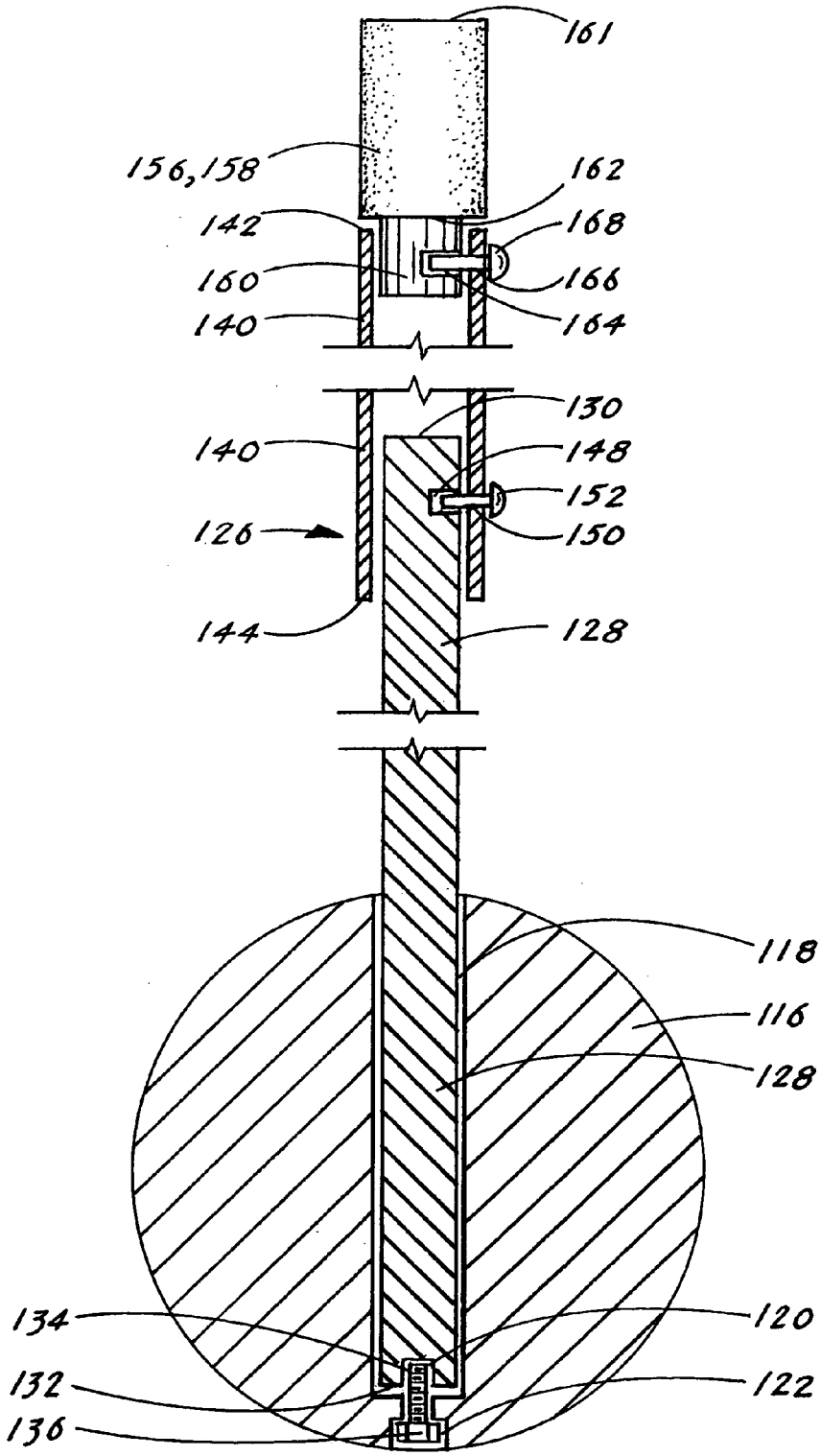
FIG. 4 is an elevational-sectional view of a solid sphere having attached a telescoping pole assembly.

The solid sphere 116, as shown in FIG. 4, has a vertically-centered combination bore and cavity that is comprised of an upper inner-pole cavity 118 that is followed sequentially downward by a bolt bore 120 and a bolt head cavity 122.

The second design of the sphere is comprised of an upper hollow hemisphere 224 and a lower hollow hemisphere 242 that together form the sphere 116. The upper hollow hemisphere 224, as shown in FIG. 4, has a lower edge 226 having a perimeter alignment protrusion 228 and a first downward extending cavity 230 that is dimensioned to slidably receive the inner pole 128. The cavity 230 has an upper edge 232 that is attached by a horizontal member 234 to the lower edge 226 of the hemisphere 224 and a lower surface 236 having a centered upper bolt bore 238.

Figure 5:
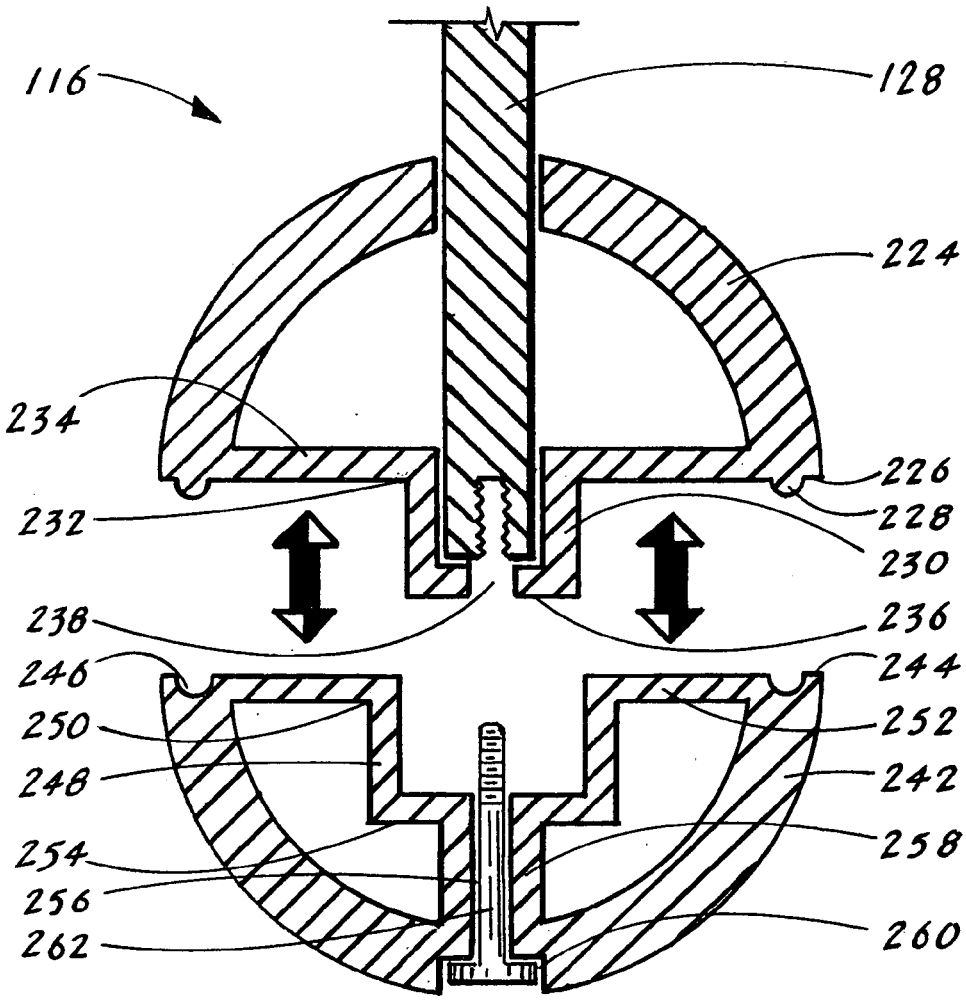
FIG. 5 is an elevational-sectional view of a separated hollow sphere having attached a portion of a telescoping pole assembly.

The lower hollow hemisphere 242, as shown in FIG. 5, has an upper edge 244, a second downward extending cavity 248 and a bolt tube 258. The upper edge 244 has a perimeter alignment cavity 246 that is dimensioned to interface with the alignment protrusion 228 on the upper hollow hemisphere 224.

The second downward extending cavity 248 is dimensioned to slidably receive the first downward extending cavity 230. The cavity 248 has an upper edge 250 that is attached by a horizontal member 252 to the upper edge 244 of the lower hollow hemisphere 242 and a lower surface 254 having a lower bolt bore 256 that is in alignment with the upper bolt bore 238.

The bolt tube 258 extends downward from the lower bolt bore 256 and terminates with a bolt head cavity 260. When a threaded bolt 262 is inserted sequentially through the bolt tube 258, the lower bolt bore 256, the upper bolt bore 238 and threaded into the threaded bore 134 on the lower end 132 of the inner pole 128, the two hemispheres are joined to form the sphere 116. The two joined edges of the hollow sphere can be welded, ground and polished to form a sphere having a smooth finish.

The final basic element disclosed for the orbital resistance-adjustable sphere exercising apparatus 10 is the telescoping pole assembly 126, as shown in FIGS. 1, 4, 6 and 7. The assembly 126 is comprised of three major elements: an upper inner pole 128, an outer pole 140, a handle 156 and a means for retaining the outer pole 140 at a selectable height with respect to the inner pole 128.

The inner pole 128 is dimensioned to be inserted into the upper inner-pole cavity 118 on the sphere 116. The inner pole 128 has an upper end 130 and a lower end 132, with the lower end 132 having a threaded bore 134 that accepts a threaded bolt 136 inserted through the bolt bore 120 on the sphere 116 that retains the inner pole 128. The outer pole 140 is dimensioned to be slidably inserted over the inner pole 128, and includes an upper end 142 and a lower end 144. The outer pole 140 is selectively height adjusted by having the inner pole 128 include at least one horizontal pin cavity 148 and the outer pole 140 include a pin bore 150. When a pin 152 is inserted through the pin bore 150 and into the pin cavity 148 the outer pole 140 is secured to the inner pole 128.

The handle 156 is attached to the upper end 142 of the outer pole 140 by a handle attachment means. When the handle is grasped, the combination of the telescoping pole assembly 126 and the sphere 116 allow several exercising routines encompassing a full range-of-motion to be performed.

Figure 6:
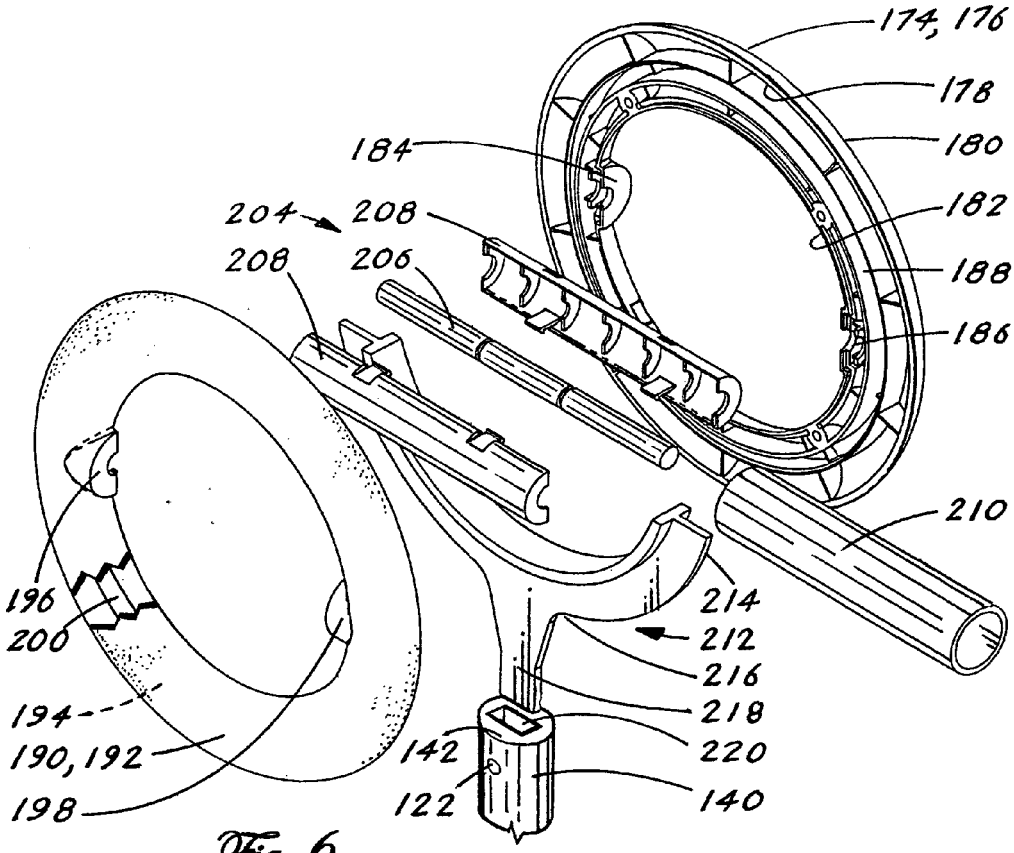
FIG. 6 is an exploded-perspective view of a T-slot articulated handle.
Figure 7:
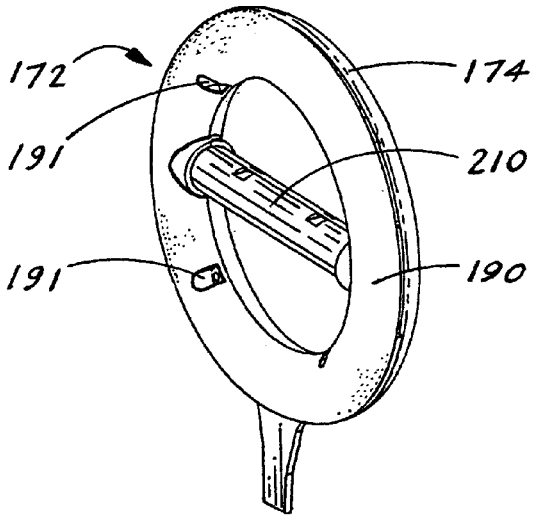
FIG. 7 is a perspective view of an assembled T-slot articulated handle.
Figure 8:
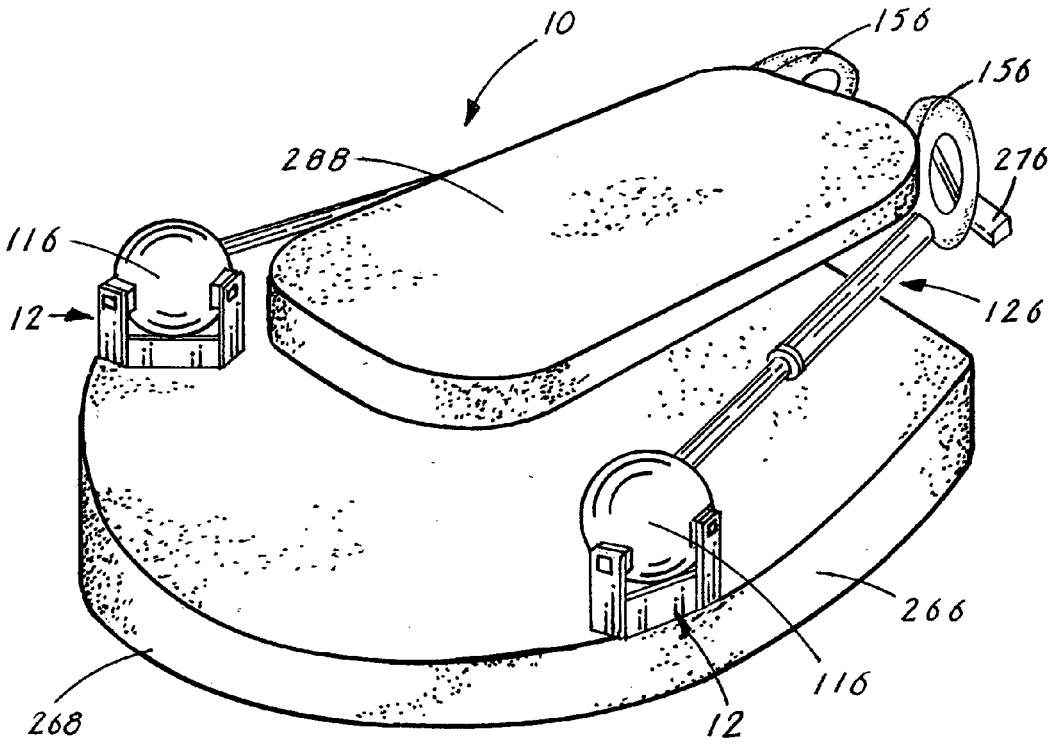
FIG. 8 is a perspective view of an orbital resistance-adjustable sphere exercising apparatus show in a collapsed configuration suitable for stowage or for traveling.

The handle 156 can consist of a vertical resilient grip handle 158, as shown in FIG. 4, or a T-slot articulated handle 172, as shown in FIGS. 1, 6 and 7. The vertical resilient grip handle 158, as shown in FIG. 4, includes an upper surface 161 and a lower surface 162. The handle attachment means is accomplished by having a cylindrical rod 160 that extends downward from the lower surface 162 of the handle 158. In this design the rod 160 has a horizontal pin cavity 164 and the outer pole 140 has a pin bore 166 therethrough that is in alignment with the pin cavity 164. When a handle retaining pin 168 is frictionally inserted through the pin bore 166 and into the horizontal pin cavity 164 the handle 158 is attached.

The T-slot articulated handle 172 allows rotation in two planes to permit freedom of movement in any direction and angle. The handle 172, as shown in FIGS. 1, 6 and 7, is comprised of five major elements: a first ring 174, a second ring 190, a hand grip 204, a yoke slider 212 and means 222 for attaching the yoke.

The first ring 174 has an outer surface 176, an inner surface 178, an outer diameter 180 and an inner diameter 182. The inner diameter 182 has one-half of a first handle cavity 184 and one-half of a second handle cavity 186 that is in alignment with the first handle cavity 184. The inner surface 178 also has one-half of a cylindrical yoke groove 188.

The second ring 190 is dimensioned to fit over and be attached by an attachment means 191 to the first ring 174. The second ring 190 also has an outer surface 192 and an inner surface 194 that includes a second-half of a first handle cavity 196 and a second half of a second handle cavity 198 that is in alignment with the first handle cavity 196. The inner surface also includes a second-half of a cylindrical yoke groove 200.

The hand grip 204 is designed to rotate through 360-degrees and is comprised of a rod 206 that is dimensioned to be rotatably inserted into the two-halves and the first and second handle cavities 184,186. Over the rod 206 is placed a handle core 208 and over the handle core 208 is inserted a resilient cover 210, as best shown in FIG. 6.

The yoke slider 212 having a T-tab 214 that slidably fits into the two-halves of the yoke grooves 188,200. The yoke slider 212 is free to rotate through 360-degrees, and includes a lower surface 216 from where extends a substantially centered yoke extension 218 that is dimensioned to fit into a yoke slot 220 located on the upper end 142 of the outer pole 140. The yoke extension 218 is attached to the yoke slot 220 by an attachment means 122 such as a pin as described above.

While the invention has been described in complete detail and pictorially shown in the accompanying drawings it is not to be limited to such details, since many changes and modifications may be made to the invention without departing from the spirit and the scope thereof. For example, the preferred design of the sphere cradle 12 is as shown in FIGS. 2 and 3. However, the sphere cradle 12 can also be designed with a circular structure, as shown in FIG. 1, that surrounds three evenly spaced and adjustable friction pads. Also, various materials can be utilized to construct the elements of the assembly 10 and colors can be included to enhance the aesthetics of the assembly. Hence, it is described to cover any and all modifications and forms which may come within the language and scope of the claims.

The invention claimed is:

1. An orbital resistance-adjustable sphere exercising apparatus comprising:

a) a sphere cradle having a base that includes a means for supporting three evenly-spaced sphere friction pads, b) a sphere that is supported by the three sphere friction pads and having an upper inner-pole cavity, c) means for adjusting the friction that is equally applied to said sphere by the three sphere friction pads, and d) a telescoping pole assembly comprising:

(1) an inner pole having an upper end and a lower end, wherein the lower end is inserted into the inner-pole cavity on said sphere and attached thereto by an attachment means, (2) an outer pole having an upper end and a lower end, wherein the lower end is slidably inserted over the inner pole and retained thereon at a selectable height by a height adjusting means, and (3) an articulated handle attached by an attachment means to the upper end of the outer pole, wherein the combination of the handle, telescoping pole assembly and the friction produced by said sphere allows several exercising routines encompassing a full range-of-motion to be performed.

2. The apparatus as specified in claim 1 wherein said apparatus can be used to perform an exercise by utilizing a single apparatus or two apparatuses.

3. The apparatus as specified in claim 1 wherein said base further having a plurality of base mounting bores that allow said base to be attached to a substantially flat surface by means of a plurality of bolts inserted into the flat surface, wherein the flat surface can consist of a solid floor or a portable platform having a front edge and a rear edge.

4. The apparatus as specified in claim 3 wherein said portable platform further comprises:

a) a seat rail having a front section and a rear T-section, wherein the front section is centrally attached to the rear edge of said portable platform, and b) a vertical member collapsibly attached to the seat rail and having a lower section and an upper section, with the lower section having means for being moved forward and backward along said seat rail, wherein the upper section having attached a back support and below the back support a collapsible seat, where when the seat is collapsed against the vertical member, the vertical member is collapsed forward along the portable platform, and the telescoping pole assemblies are rotated into a flat position, said apparatus is placed in a stowed or traveling position.

5. The apparatus as specified in claim 1 wherein the sphere friction pads are made of ultrahigh molecular weight polyethylene (UHMW-PE) and have an inner concave surface that follows the curvature of said sphere.

6. The apparatus as specified in claim 1 wherein said handle consists of a T-slot articulated handle that allows rotation in two planes to permit freedom of movement in any direction and angle, said handle comprising:

a) front ring having an outer surface, an inner surface, an outer diameter and an inner diameter, wherein the inner diameter having one-half of a first handle cavity and one-half of a second handle cavity in alignment with the first handle cavity, wherein the inner surface having one-half of a cylindrical yoke groove, b) a rear ring dimensioned to fit over and be attached by an attachment means to the front ring, said rear ring having an outer surface, and an inner diameter, wherein the inner diameter having one-half of a complimentary first handle cavity and one-half of a complimentary second handle cavity that is in alignment with the first handle cavity, wherein the inner surface having one-half of a complimentary cylindrical yoke groove, c) a hand grip designed to rotate through 360-degrees comprising:

(1) a tube dimensioned to be rotatably inserted into the two-halves of the first and second handle cavities, (2) a handle core placed over the tube, (3) a resilient cover inserted over the handle core, and d) a yoke slider having a T-slot that slidably fits into the two-halves of the yoke groove, wherein said yoke slider is free to rotate through 360 degrees, and includes a lower surface from where extends a substantially centered yoke extension that is dimensioned to fit into and be attached to a yoke slot located on the upper end of the outer pole.

7. An orbital resistance-adjustable sphere exercising apparatus comprising:

a) a sphere cradle comprising:

(1) a base having an equilateral triangular shape, a lower surface, an upper surface, a plurality of base mounting bores, a first truncated apex, a second truncated apex and a third truncated apex, (2) a first sphere support frame having a lower edge in alignment with the lower surface of the base, an upper edge, and a first sphere friction pad opening located adjacent the upper edge, wherein the first sphere support frame is fixedly attached by an attachment means to the first truncated apex, (3) a first sphere friction pad having an inner concave surface and an outer surface having a protrusion dimensioned to be inserted and frictionally held within the first sphere friction pad opening, (4) a second sphere support frame having a lower edge in alignment with the lower surface of the base, an upper edge, and a second sphere friction pad opening located adjacent the upper edge, wherein the second sphere support frame is fixedly attached by an attachment means to the second truncated apex, (5) a second sphere friction pad having an inner concave surface and an outer surface having a protrusion dimensioned to be inserted and frictionally held within the second sphere friction pad opening, (6) a first side panel fixedly attached by an attachment means between the first sphere support frame and the second sphere support frame, (7) a second side panel having a first edge fixedly attached by an attachment means, to the first sphere support frame and a second edge that terminates at a first edge of the third truncated apex, (8) a third side panel having a first edge fixedly attached by an attachment means to the second sphere support frame and a second edge that terminates at a second edge of the third truncated apex, (9) a cross-member attached inward and across the second edges of the second and third side panels respectively, with the cross-member having an inner surface and an outer surface, with the inner surface having a bolt-head retaining cavity that interfaces with a bolt bore extending therethrough,

(10) a pressure adjusting threaded bolt inserted into the bolt bore, with the bolt head captively held within the bolt-head retaining cavity and the threaded section of the bolt extending outward from the plane of the third truncated apex,

(11) a third sphere support frame having a lower edge in alignment with the lower surface of the base between the second edges of the second and third side panels, an upper edge, a third sphere friction pad opening located adjacent the upper edge and a bolt bore in alignment with the threaded bolt,

(12) a third sphere friction pad having an inner concave surface and an outer surface having a protrusion dimensioned to be inserted and fricitonally held within the third sphere friction pad opening,

(13) a washer inserted into the threaded section of the pressure adjusting threaded bolt,

(14) a sphere friction adjusting rod having an inner surface and an outer surface, wherein the inner surface having a threaded cavity that is threaded into the threaded section of the pressure adjusting threaded bolt, with the inner surface interfacing with the washer, wherein when the rod is rotated clockwise, the third sphere support frame moves inward, thus allowing the three sphere friction pads to simultaneously extend inward and each apply an equal inward pressure, likewise; when the rod is rotated counter-clockwise the equal inward pressure is reduced, b) a sphere having a vertically-centered, combination bore and cavity comprising an upper inner-pole cavity followed sequentially downward by a bolt bore and a bolt head cavity, c) a telescoping pole assembly comprising:

(1) an inner pole dimensioned to be inserted into the upper inner-pole cavity on said sphere, said inner pole having an upper end and a lower end, with the lower end having a threaded bore that accepts a threaded bolt inserted through the bolt bore on said sphere, (2) an outer pole dimensioned to be slideably inserted over the inner pole, said outer pole having an upper end and a lower end, (3) means for retaining the outer pole at a selectable height with respect to the inner pole, and (4) a handle attached to the upper end of the outer pole by a handle attachment means, wherein when the handle is grasped, the combination of said telescoping pole assembly and said sphere allow several exercising routines encompassing a full range-of-motion to be performed.

8. The apparatus as specified in claim 7 wherein the base of at least one sphere cradle is attached to a substantially flat surface by means of a plurality of bolts inserted into the plurality of mounting bores.

9. The apparatus as specified in claim 8 wherein said flat surface is comprised of a solid floor.

10. The apparatus as specified in claim 9 wherein said sphere comprises:

a) an upper hollow hemisphere having:

(1) a lower edge having a perimeter alignment protrusion, (2) a first downward extending cavity dimensioned to slidably receive the inner pole, said cavity having an upper edge that is attached by a horizontal member to the lower edge of said hemisphere and a lower surface having a centered upper bolt bore, b) a lower hollow hemisphere having:

(1) an upper edge having a perimeter alignment cavity dimensioned to interface with the alignment protrusion on said upper hollow hemisphere, (2) a second downward extending cavity dimensioned to slidably receive the first downward extending cavity, said cavity having an upper edge that is attached by a horizontal member to the upper edge of said hemisphere and a lower surface having a lower bolt bore in alignment with the upper bolt bore, and (3) a bolt tube extending downward from the lower bolt bore and terminating with a bolt head cavity, wherein when a threaded bolt is inserted sequentially through the bolt tube, the lower bolt bore, the upper bolt bore and threaded into the threaded bore on the lower end of the inner pole, the two hemispheres are joined to form a sphere.

11. The apparatus as specified in claim 10 wherein the two joined edges of the hollow sphere are welded, ground and polished to form a sphere having a smooth finish.

12. The apparatus as specified in claim 8 wherein said flat surface is comprised of a portable platform comprising a front edge and a rear edge.

13. The apparatus as specified in claim 12 wherein said portable platform further comprises a seat rail having a front section and a rear T-section, wherein the front section is centrally attached to the rear edge of said portable platform.

14. The apparatus as specified in claim 13 further comprising a vertical member collapsibly attached to the seat rail and having a lower section and an upper section, with the lower section having means for being moved forward and backward along said seat rail, wherein the upper section having attached a back support and below the back support a collapsible seat, where when the seat is collapsed against the vertical member, the vertical member is collapsed forward along the portable platform, and the telescoping pole assemblies are rotated into a flat position, said apparatus is placed in a stowed or traveling position.

15. The apparatus as specified in claim 7 wherein said first, second and third friction pads are made of ultrahigh molecular weight polyethylene (UHMW-PE).

16. The apparatus as specified in claim 7 wherein said means for fixedly attaching the sphere support frames and the side panels is by a welding process.

17. The apparatus as specified in claim 7 wherein said washer is comprised of a steel needle-roller thrust bearing.

18. The apparatus as specified in claim 7 wherein said sphere adjusting rod further comprises a plurality of outward extending knobs that facilitate the rotation of the rod.

19. The apparatus as specified in claim 7 wherein said sphere is constructed of solid anodized aluminum.

20. The apparatus as specified in claim 7 wherein said means for retaining the outer pole at a selectable height comprises:

a) said inner pole having at least one horizontal pin cavity, b) said outer pole having at least one pin bore in alignment with the at least one horizontal pin cavity, and c) a pin frictionally inserted through the pin bore and into the pin cavity.

21. The apparatus as specified in claim 7 wherein said handle is comprised of a vertical resilient grip handle having an upper surface and a lower surface.

22. The apparatus as specified in claim 21 wherein said means for attaching the vertical resilient grip handle comprises:

a) a cylindrical rod extending downward from the lower surface of said handle, the rod having a horizontal pin cavity, b) said outer pole having a pin bore therethrough in alignment with the pin cavity, and c) a pin frictionally inserted through the pin bore and into the pin cavity.

23. The apparatus as specified in claim 7 wherein said handle consists of a T-slot articulated handle that allows rotation in two planes to permit freedom of movement in any direction and angle, said handle comprising:

a) a first ring having an outer surface, an inner surface, an outer diameter and an inner diameter, wherein the inner diameter having one-half of a first handle cavity and one-half of a second handle cavity in alignment with the first handle cavity, wherein the inner surface having one-half of a cylindrical yoke groove, b) a second ring dimensioned to fit over and be attached by an attachment means to the first ring, said second ring having an outer surface, and an inner diameter, wherein the inner diameter having a second-half of a first handle cavity and a second-half of a second handle cavity that is in alignment with the first handle cavity, wherein the inner surface having a second-half of a complimentary cylindrical yoke groove, c) a hand grip designed to rotate through 360-degrees comprising:

(1) a rod dimensioned to be rotatably inserted into the two-halves of the first and second handle cavities, (2) a handle core placed over the rod, (3) a resilient cover inserted over the handle core, d) a yoke slider having a T-tab that slidably fits into the two-halves of the yoke groove, wherein said yoke slider is free to rotate through 360-degrees, and includes a lower surface from where extends a substantially centered yoke extension that is dimensioned to fit into a yoke slot located on the upper end of the outer pole, and e) means for attaching the yoke extension to the yoke slot.

* * * * *